United States Patent [19]

Hamada et al.

[11] Patent Number: 4,505,745

[45] Date of Patent: Mar. 19, 1985

[54] METHODS OF PRODUCING AND USING AMORPHOUS MOTHER ALLOY

[75] Inventors: Takao Hamada; Nobuo Tsuchiya; Yo Ito; Toshihiro Inatani; Yoshiyasu Takada; Mitsuo Sumito, all of Chiba; Toshimitsu Koitabashi; Hideshi Katayama, both of Ichihara, all of Japan

[73] Assignee: Kawasaki Steel Corporation, Kobe, Japan

[21] Appl. No.: 524,444

[22] Filed: Aug. 18, 1983

[30] Foreign Application Priority Data

Aug. 27, 1982 [JP] Japan ..... 57-148787

[51] Int. Cl.[3] ..... C22C 33/00

[52] U.S. Cl. ..... 75/129; 75/10 R

[58] Field of Search ..... 75/10 R, 11, 129

[56] References Cited

U.S. PATENT DOCUMENTS 4,397,691 8/1983 Hamada ..... 75/123 B

*Primary Examiner*—Peter D. Rosenberg

*Attorney, Agent, or Firm*—Balogh, Osann, Kramer, Dvorak, Genova & Traub

[57] ABSTRACT

A method of producing amorphous mother alloy is disclosed, which comprises charging raw material, carbonaceous reducing agent and secondary material into a smelting furnace and then smelting to produce Fe-B-Si series molten metal having a B-Si composition range which lies within an area represented by the trapezoidal area abcd shown in FIG. 2 of the accompanying drawings. The amorphous mother alloy is used to produce an amorphous starting material by diluting with molten steel.

2 Claims, 9 Drawing Figures

METHODS OF PRODUCING AND USING AMORPHOUS MOTHER ALLOY

This invention relates to an amorphous mother alloy and methods of producing and using the same.

Amorphous alloys consisting mainly of Fe-B have excellent properties as an electromagnetic material. If it is intended to use such amorphous alloys as a core material of a transformer, the iron loss is about $\frac{1}{3}$ that of conventional grain-oriented silicon steel sheets, but they are not yet put to practical use.

As a greatest cause, the cost of this amorphous alloy is fairly expensive as compared with that of the silicon steel sheet. Since at least a half of the cost for producing an amorphous ribbon is the price of boron, it is important to provide a method of producing boron-containing materials in a low cost.

Elementary boron is expensive and is not suitable as a starting material for the production of amorphous alloy. Ferroboron may be produced by a thermit process with aluminum or an electric furnace process. However, the thermit process is not suitable for amorphous materials because aluminum is included in ferroboron, while the electric furnace process has a problem in areas of high power price because an amount of electric power consumed is large.

The inventors have already proposed a method of producing Fe-B series molten metal by using carbon as a reducing agent without the metal such as Al or the like and the electric power as described in Japanese Patent Laid Open No. 58-77,509. In this connection, the inventors have made further studies with respect to the advantageous production of Fe-B-Si series molten metal having B and Si contents suitable for amorphous material and a low C content.

The invention will now be described in detail with reference to the accompanying drawings, wherein.

Figure 3A:
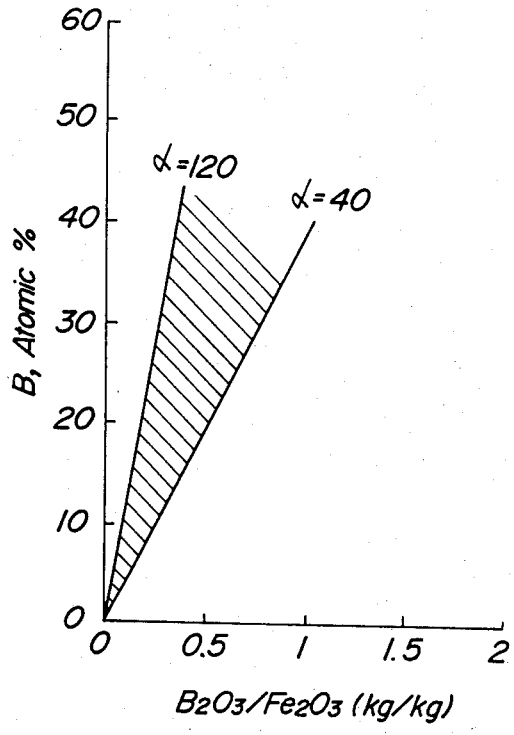
Figure 3B:
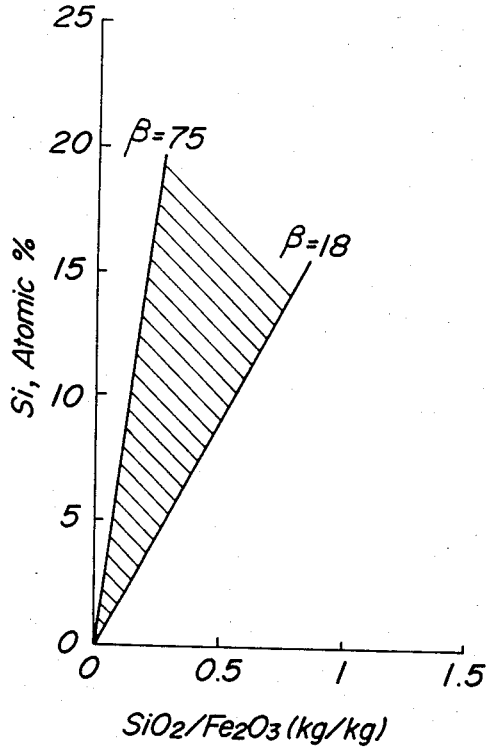
Figure 4:
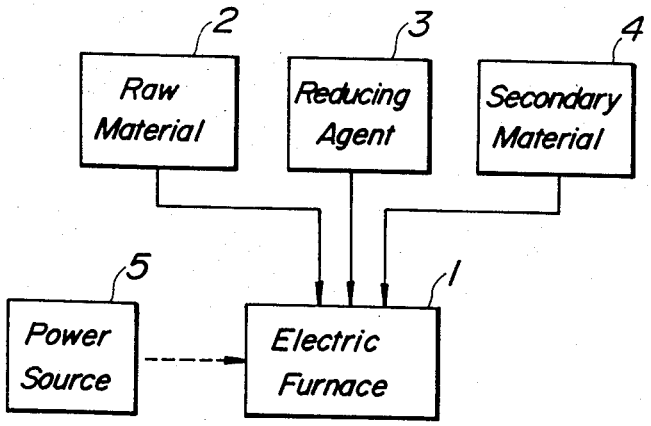
Figure 5:
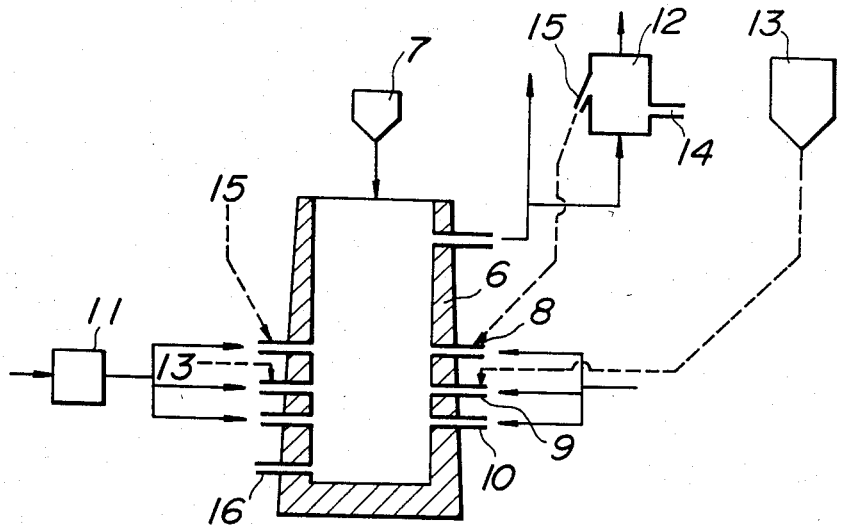
Figure 6:
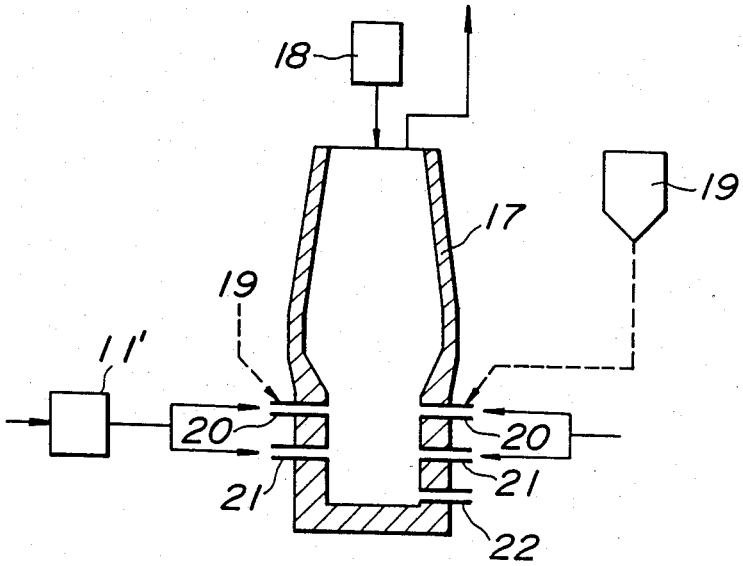
Figure 7A:
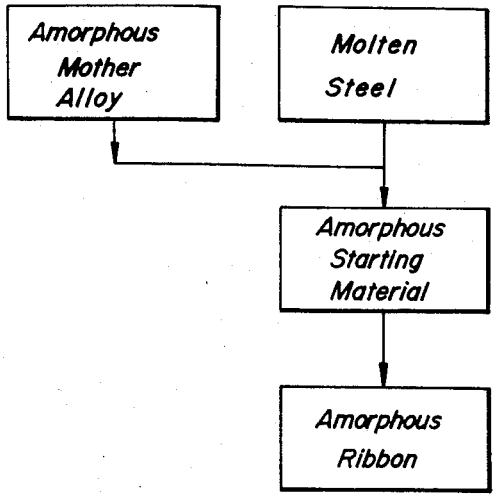
Figure 7B:
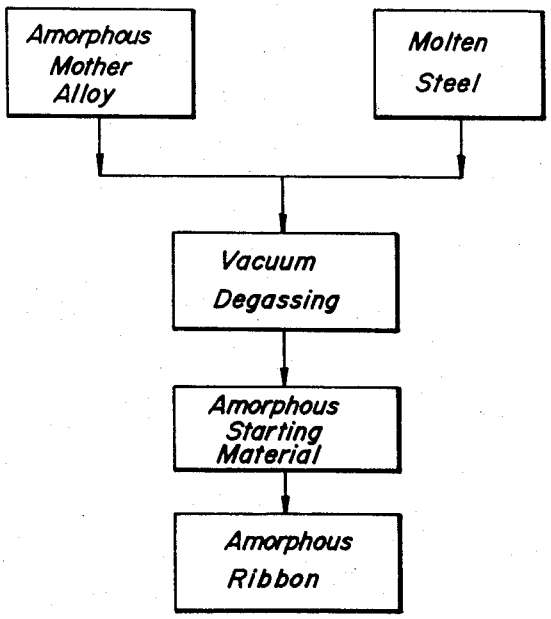

FIG. 3*a* is a graph showing a relation between $B_2O_3/Fe_2O_3$ and B atomic %;

FIG. 3*b* is a graph showing a relation between $SiO_2/Fe_2O_3$ and Si atomic %;

FIG. 4 is a system diagram illustrating the production of amorphous mother alloy in an electric furnace according to the invention;

FIGS. 5 and 6 are systematic views illustrating the production of amorphous mother alloy in a melting reduction furnace and a shaft furnace, respectively, according to the invention; and FIGS. 7*a* and 7*b* are flow sheets illustrating the production of amorphous mother alloy to amorphous ribbon according to the invention, respectively.

As regards the composition of Fe-B-Si series molten metal (hereinafter referred to as an amorphous starting material) for the production of amorphous alloy ribbons, it has hitherto been well-known from many studies that B, Si and C contents are suitable within the following ranges, respectively:

$$\left.\begin{array}{l} \frac{1}{4} < \text{Si (atomic \%)/B (atomic \%)} < 1, \\ 16 < \text{B (atomic \%)} + \frac{2}{3}\text{Si (atomic \%)} < 25, \text{ and} \\ \text{C (atomic \%)} < 1 \end{array}\right\} \quad (1)$$

Figure 1:
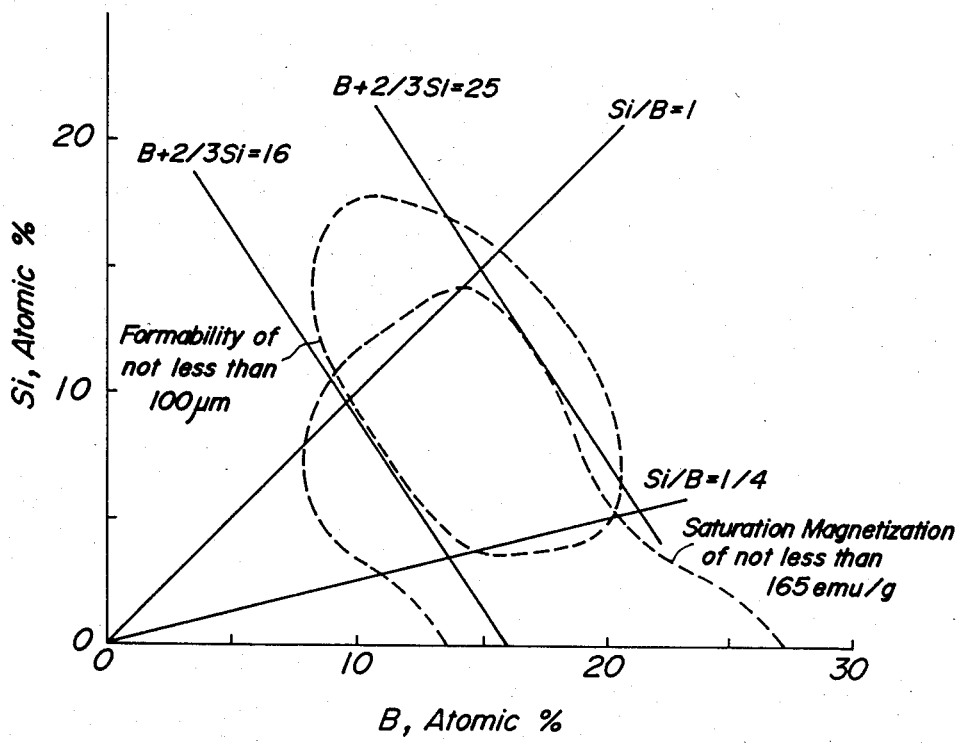
FIG. 1 is a graph showing a relation among composition range of amorphous mother alloy, amorphous formability and saturation magnetization.

In the production of amorphous alloy ribbon, it is usually important that the amorphous substance is first formed, the saturation magnetization if good as an electromagnetic property, and the thermal stability for producing no crystallization when heating the product is good. In order to obtain a good amorphous formability as shown in FIG. 1, it is necessary to satisfy the following relations:

$$\text{Si(atomic \%)/B(atomic \%)} > \tfrac{1}{4},$$

and $$\text{B(atomic \%)} + \tfrac{2}{3}\text{Si(atomic \%)} > 16,$$

but if not satisfied, the amorphous formability lowers. On the other hand, in order to obtain a given saturation magnetization, it is necessary to satisfy the following relations:

$$\text{Si(atomic \%)/B(atomic\%)} < 1,$$

and $$\text{B(atomic \%)} + \tfrac{2}{3}\text{Si(atomic \%)} < 25,$$

but if not satisfied, the saturation magnetization deteriorates. Moreover, C content is necessary to be not more than 1 atomic % in view of the thermal stability.

Ferroboron usually produced in an electric furnace contains 10 to 20% by weight of B and not more than 2% by weight of Si. If this ferroboron is used as a starting material in order to produce the amorphous starting material having the composition range of the item (1), it is necessary to add a large amount of metallic Si as Si source in addition to molten steel. In this case, the cost of the amorphous starting material becomes piled up because the prices of the above ferroboron and metallic Si are expensive.

Figure 2:
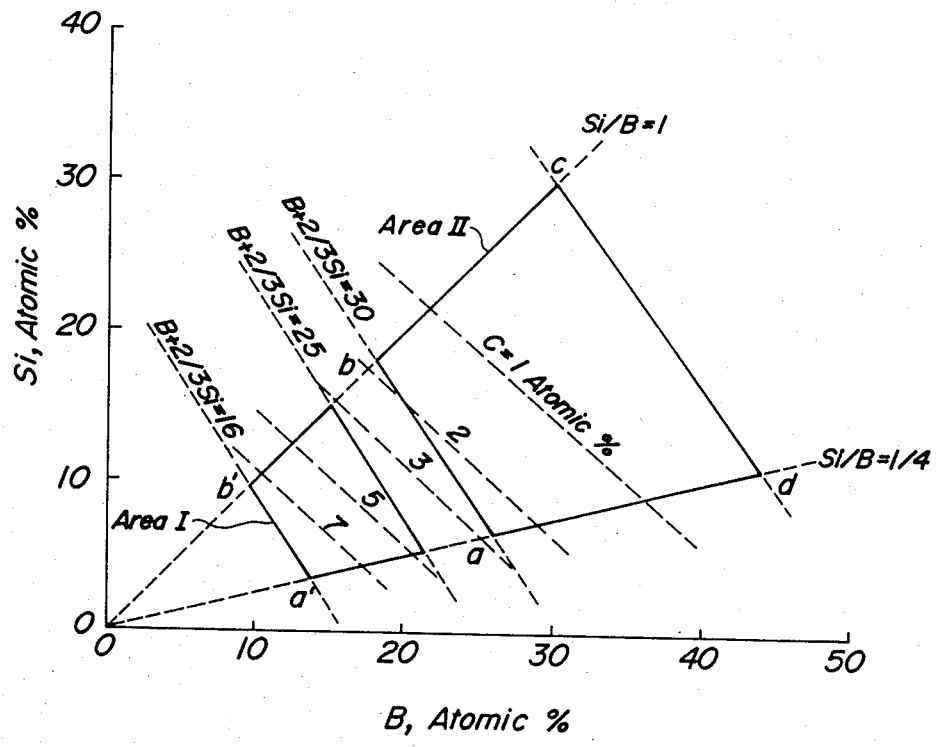
FIG. 2 is a graph showing a relation among B, Si and C contents in Fe-B-Si series molten metal according to the invention on composition ranges of amorphous mother alloy and amorphous starting material.

The inventors have made experiments with respect to the production of Fe-B series molten metals using, particularly, carbon as a reducing agent in a melting reduction furnace, a blast furnace or an electric furnace and found that the B, Si and C contents have a correlation as shown in FIG. 2.

That is, the larger the B and Si contents, the smaller the C content, or conversely the smaller the B and Si contents, the larger the C content. Therefore, if it is intended to directly produce molten metals having an optimum range of B and Si contents shown in FIG. 1 (i.e., an area I of FIG. 2) by using carbon as a reducing agent, the C content is several atomic % and is over the optimum range, so that it is necessary to make the C content to not more than 1 atomic % by another means.

In order to reduce (decarburize) the C content, however, extra steps such as vacuum decarburization treatment under oxidation of C and the like are required. Further, since B is similar in thermodynamic properties to C and is apt to be oxidized, a part of B in molten metal is lost by oxidation. Therefore, the reduction of C content by another means is disadvantageous in view of the production cost.

Now, the inventors have made further investigations on such disadvantages and found that these disadvantages can advantageously be solved (1) by producing Fe-B-Si series molten metal having high B and Si contents and low C content hereinafter referred to as an amorphous mother alloy), and (2) by mixing and diluting the amorphous mother alloy with molten steel to produce and amorphous starting material.

Namely, the amorphous starting material having the composition range of the aformentioned item (1) can be produced without decarburization by producing the amorphous mother alloy having an area II of FIG. 2 wherein B and Si contents are high and C content is low, and then diluting it with molten steel to adjust the B and Si contents to the ranges of the area I.

In the composition range of the area II, the ratio of Si/B on atomic % is unchangeable even when diluting with molten steel and is $\frac{1}{4}<Si/B<1$ likewise the case of the area I. Further, it is apparent from FIG. 2 that B and Si contents is necessary to satisfy the following relation:

$$B(\text{atomic }\%)+\tfrac{2}{3}Si(\text{atomic }\%)>30$$

taking account of a condition that the amorphous mother alloy having a highest C content at a point a of the area II is diluted with molten steel to adjust the C content of the amorphous starting material at a point a' to not more than 1 atomic %.

As a result of investigations on operation condition for the production of amorphous mother alloy having the above composition range, it has been found to have the relations as shown in FIGS. 3*a* and 3*b*, wherein an abscissa is a ratio of $B_2O_3$ or $SiO_2$ to $Fe_2O_3$ obtained by converting all of B, Si and Fe contents in raw material, reducing agent and secondary material, which are charged into a furnace for the production of amorphous mother alloy, into amounts of $B_2O_3$, $SiO_2$ and $Fe_2O_3$ charged as an oxide. From these experimental results, it has been found to satisfy the following relations:

$$B,\ \text{atomic }\% = \alpha \times \frac{\text{amount of } B_2O_3 \text{ charged}}{\text{amount of } Fe_2O_3 \text{ charged}}, \text{ and}$$

$$Si,\ \text{atomic }\% = \beta \times \frac{\text{amount of } SiO_2 \text{ charged}}{\text{amount of } Fe_2O_3 \text{ charged}}$$

In this case, $\alpha$ and $\beta$ depend upon the kind and particle size of boron compound, silicon compound and solid reducing agent as well as reducing conditions of the furnace such as temperature, pressure and the like, but they are within ranges of $\alpha=40\sim120$ and $\beta=18\sim75$ as shown in shadowed portions of FIGS. 3*a* and 3*b* in the usual operation. The larger the value of $\alpha$, the larger the value of $\beta$, so that a ratio of $\beta$ to $\alpha$ has a relation of $\beta/\alpha=0.45\sim0.625$.

From the above relations, the amount of $B_2O_3$, $SiO_2$ and $Fe_2O_3$ charged for the production of amorphous mother alloy having the composition of the area II in FIG. 2 have the following relations:

$$4(\beta/\alpha)>\text{amount of } B_2O_3 \text{ charged/amount of } SiO_2 \text{ charged}>(\beta/\alpha),$$

and $$\alpha(\text{amount of } B_2O_3 \text{ charged})+\tfrac{2}{3}\beta(\text{amount of } SiO_2 \text{ charged})>30(\text{amount of } Fe_2O_3 \text{ charged}),$$

from which there are obtained the following relations:

$$0.4<(\text{amount of } B_2O_3 \text{ charged})/(\text{amount of } SiO_2 \text{ charged})<2.5,$$

and $$(\text{amount of } SiO_2 \text{ charged})/(\text{amount of } Fe_2O_3 \text{ charged})>0.08$$

The composition range of the amorphous mother alloy according to the invention composed of the novel Fe-B-Si series molten metal thus obtained forms a trapezoid between B-Si composition ranges shown in FIG. 2, which is specified by an area abcd wherein vertex a is a co-ordinate (26, 6.5), vertex b a co-ordinate (18, 18), vertex c a co-ordinate (30, 30) and vertex d a co-ordinate (44, 11).

The molten steel to be mixed with the amorphous mother alloy includes, for example, usual rimmed steel and killed steel having the following compositions (% by weight):

| | C | Si | O |
|---|---|---|---|
| Rimmed steel | 0.04~0.07 | trace~0.01 | 0.04~0.06 |
| Killed steel | 0.04~0.15 | trace~0.4 | 0.002~0.005 |

which have not a great influence upon the composition ranges of C and Si in the amorphous starting material.

Therefore, the degree of diluting the amorphous mother alloy with molten steel is easily determined from a ratio of B content of the mother alloy to target B content of the starting material.

The following examples are given in illustration of the invention and are not intended as limitations thereof.

EXAMPLE 1

An amorphous mother alloy is produced according to a system diagram of FIG. 4 using a usual electric furnace.

Into an electric furnace 1 are charged a boron compound such as boric acid, boron oxide or the like and an iron compound such as iron powder, mill scale, iron ore or the like from a raw material hopper 2, a solid fuel such as coke, char, charcoal or the like from a reducing agent hopper 3, and a substance such as silica sand, silica, limestone, dolomite, fluorite or the like from a secondary material hopper 4 at given amounts, which are smelted by supplying electric power from a power source 5.

An operation example using the above electric furnace (100 KVA) was shown as follows:

| | | | |
|---|---|---|---|
| (1) | Charging materials | boron oxide | 2,100 kg |
| | | mill scale | 4,800 kg |
| | | silica sand | 2,900 kg |
| | | coke | 3,700 kg |
| (2) | Smelting time | 180 min. | |
| (3) | Amount of molten metal produced | | 5.2 tons |
| | Composition | B | 34 atomic %, |
| | | Si | 17 atomic %, |
| | | C | 0.6 atomic % |
| | (B 10.3%, Si 13.4%, C 0.2% on weight %). | | |

The composition of the resulting molten metal is identified to be within the trapezoidal area II of FIG. 2.

EXAMPLE 2

An amorphous mother alloy is produced according to a systematic view of FIG. 5 using a melting reduction furnace.

A carbonaceous solid reducing agent, preferably lump coke is charged into a shaft furnace 6 through a charging device 7 to form a reducing agent-packed bed in the shaft furnace 6. Two or three stages of tuyeres are provided in a lower portion of the shaft furnace 6. In this example, the upper stage is tuyeres 8 for feeding a preliminarily reduced iron ore together with hot air, the lower stage is tuyeres 9 for feeding boron oxide or boric acid together with hot air, and the lowest stage is tuyeres 10 for feeding only hot air, if necessary.

To each tuyere is blown hot air (air or oxygen-rich air) heated at a high temperature through a hot stove 11, and simultaneously iron oxide preliminarily reduced in a fluidized preliminarily reducing furnace 12 and a boron-containing powdery substance such as boron oxide or boric acid stocked in a hopper 13 are blown from the upper stage tuyeres 8 and from the lower stage tuyeres 9, respectively, as shown in FIG. 5.

The preliminarily reduced iron oxide is prepared by reducing iron oxide supplied to the fluidized preliminarily reducing furnace 12 through a charging device 14 with a high temperature exhaust gas generated, for example, in the shaft furnace 6.

The preliminarily reduced iron oxide is transferred from an outlet 15 of the preliminarily reducing furnace 12 to upper stage tuyeres 8 and boron oxide or boric acid is transferred from the hopper 13 to lower stage tuyeres 9 by applying the principles of gravitational transport and pneumatic transport.

In front of the upper stage tuyeres 8, the lower stage tuyeres 9 and if necessary, the lowest stage tuyeres 10 in the shaft furnace 6, are produced raceways in the same manner as in the vicinity of the top of tuyeres of a blast furnace due to hot air to form zones having a high temperature of 2,000°-2,500° C., at where the preliminarily reduced iron oxide and boron oxide, which are fed into these zones together with hot air or hot air added with oxygen, are immediately heated and easily melted.

The melts are reduced during dropping down through coke-packed beds at the lower portion of the furnace 6 to form a molten metal and a molten slag, which are pooled at the hearth of the furnace and timely discharged out of the furnace from a taphole 16.

An operation example using the above melting reduction furnace was shown as follows:

| | | |
|---|---|---|
| (1) | Boron-containing substance | boron oxide |
| | Particle size | less than 200 meshes |
| | Charged amount to the lower stage tuyeres 9 | 240 kg/hr |
| (2) | Iron ore | Carol Lake ore |
| | Particle size | less than 2 mm |
| | Charged amount to the preliminarily reducing furnace 12 | 340 kg/hr |
| | Charged amount to the upper stage tuyeres 8 | 280 kg/hr |
| | Preliminary reduction ratio | 78% |
| (3) | Carbonaceous solid reducing agent | coke |
| | Particle size | 20-30 mm |
| | Charged amount | 800 kg/hr |
| (4) | Amount of air blown into the shaft furnace | 1,800 $Nm^3$/hr |
| | Blown air temperature | 900° C. |
| | Number of air blowing tuyeres Total: 12, In each of the upper, lower and lowest stages: 4 (To the four upper stage tuyeres: preliminarily reduced iron ore, To the four lower stage tuyeres: boron oxide.) | |
| (5) | Amount of Fe—B—Si—C series molten metal produced (B = 33 atomic %, Si = 17 atomic %, C = 0.8 atomic %, Fe = balance) (B 9.9%, Si 13.3%, C 0.3% on weight %) | 290 kg/hr |
| (6) | Amount of slag discharged | 200 kg/hr |

The resulting molten metal belongs to the trapezoidal area II of FIG. 2.

EXAMPLE 3

An amorphous mother alloy is produced according to a systematic view of FIG. 6 using the same shaft furnace 17 as a blast furnace for producing usual pig iron.

Powdery ores as iron oxide are first transformed into sintered ores or pellets and then charged into the shaft furnace 17 from a feeding device 18 at the furnace top alternately with lump coke. The lump ores are directly charged in the shaft furnace in the same manner as described above. Iron oxide is heated and reduced during descending in the furnace and melted and dropped down through the coke-packed bed.

Boron oxide or boric acid is transferred from a hopper 19 to tuyeres 20 and fed into the shaft furnace together with hot air fed from a hot stove 11'. When a heat energy at the lower portion of the furnace is deficient, tuyeres 21 for feeding only hot air are additionally provided at the lower stage and the necessary heat energy is supplemented. Numeral 22 is a taphole.

The difference of the examples in FIGS. 5 and 6 lies in that the preliminarily reduced iron oxide is fed from the tuyeres of lump form of iron oxide not preliminarily reduced is fed from the furnace top.

As silica source in Examples 2 and 3, there are $SiO_2$ contained in gangue mineral of iron ore and in ash of coke, silica or silica sand charged from the top of the shaft furnace or the tuyere into the furnace, and the like.

An operation example using the above shaft furnace is shown as follows:

| | | |
|---|---|---|
| (1) | Boron-containing substance | boric acid |
| | Particle size | less than 200 meshes |
| | Charged amount to the upper stage tuyeres 20 | 250 kg/hr |
| (2) | Iron ore | sintered ore |
| | Particle size | 5-10 mm |
| | Charged amount | 360 kg/hr |
| (3) | Solid reducing agent | coke |
| | Particle size | 20-30 mm |
| | Charged amount | 820 kg/hr |
| (4) | Amount of air blown | 1,700 $Nm^3$/hr |
| | Blown air temperature | 900° C. |
| | Number of air blowing tuyeres In each of the upper and lower stages: 4 Total: 8 (To the four upper stage tuyeres 20: boric acid) | |
| (5) | Amount of Fe—B—Si—C series molten metal produced (B = 34 atomic %, Si = 15 atomic %, C = 0.7 atomic %, Fe = balance) (B 10.2%, Si 11.7%, C 0.2% on weight %) | 280 kg/hr |

-continued

| | | |
|---|---|---|
| (6) | Amount of slag discharged | 230 kg/hr |

The thus obtained molten metal is said to be within the trapezoidal area II of FIG. 2.

As mentioned above, amorphous mother alloys having the composition range of the area II shown in FIG. 2 can easily be produced by anyone of the methods using the electric furnace, melting reduction furnace and blast furnace.

By mixing the amorphous mother alloy of the area II with molten steel, amorphous starting materials having the composition range of the aformentioned item (1) can be produced without decarburization, silicon addition and desiliconization as shown in the following Example 4.

EXAMPLE 4

An amorphous starting material is produced from an amorphous mother alloy as follows:

| | | |
|---|---|---|
| (1) | Amorphous mother alloy | molten metal obtained in Example 2 |
| | composition | B = 33 atomic %, Si = 17 atomic %, C = 0.8 atomic % (B = 9.9 weight %, Si = 13.3 weight %, C = 0.3 weight %) |
| (2) | Molten steel | molten steel obtained by refining pig iron from a blast furnace in a converter |
| | composition | C = 0.12 weight %, Si = 0.1 weight %, B = 0 weight % |
| (3) | Mixing ratio | |
| | amorphous mother alloy | 800 kg |
| | molten steel | 1,760 kg |
| (4) | Amorphous starting material | |
| | weight | 2,560 kg |
| | composition | B = 3.1 weight %, Si = 4.2 weight %, C = 0.15 weight % |

When converting the composition of the amorphous starting material from weight % into atomic %, B=13.6 atomic %, Si=7.1 atomic % and C=0.6 atomic %, which come into $$\tfrac{1}{4} < \mathrm{Si(atomic\ \%)/B(atomic\ \%)} = 0.52 < 1,$$

$$16 < \mathrm{B(atomic\ \%)} + \tfrac{2}{3}\mathrm{Si(atomic\ \%)} = 18.3 < 25$$

and $$\mathrm{C(atomic\ \%)} = 0.6 < 1.$$

From the above, it is obvious that low-carbon amorphous starting materials having an optimum composition range of the item (1) are easily obtained from the amorphous mother alloy according to the invention.

Moreover, when diluting the amorphous mother alloy with moltem steel as described in Example 4 and shown in FIG. 7*a*, inclusions may be produced by oxidation of Al, Ti, B, Si and the like due to the presence of dissolved oxygen. Such inclusiions result in the clogging of nozzle and the deterioration of amorphous formability when producing amorphous ribbons from the amorphous starting material.

In order to prevent the occurrence of inclusions when diluting the amorphous mother alloy with molten steel, it is effective to perform the stirring of molten metal by blowing argon gas or the refining in a vacuum degassing equipment for RH or DH process as shown in FIG. 7*b* and apparent from the following Example 5.

EXAMPLE 5

When diluting 10 kg of amorphous mother alloy (Si 12.3 weight %, B 10.0 weight %, C 0.23 weight %, soluble Al 0.32 weight %, insoluble Al 0.30 weight %) with 15 kg of molten steel (semi-killed steel, C 0.12 weight %), the following runs are carried out to obtain results as shown in the following Table 1.

Run No. A is the case of merely diluting the amorphous mother alloy with molten steel, Run No. B is the case of blowing argon gas under a pressure of 0.1 atm during the dilution, and Run No. C is the case of blowing oxygen gas under a pressure of 0.1 atm during the dilution.

TABLE 1

| Run No. | B | Si | C | (weight %) soluble Al | (weight %) insoluble Al |
|---|---|---|---|---|---|
| A | 3.8 | 4.8 | 0.19 | 0.06 | 0.08 |
| B | 4.1 | 5.1 | 0.15 | 0.01 | 0.01 |
| C | 3.5 | 4.6 | 0.06 | 0.007 | 0.006 |

In case of Run No. A, the clogging of nozzle is frequently caused in the production of amorphous starting material to amorphous ribbon and also the amorphous formability is deteriorated, while in case of Run Nos. B and C, the clogging of nozzle is not caused and the amorphous formability is good.

As apparent from the above, the invention has the following merits:

(1) Amorphous mother alloys having high B and Si contents and low C content can easily and cheaply be produced by using a carbonaceous reducing agent;

(2) In the production of the amorphous mother alloy, decarburization step as well as silicon addition or desiliconization step are unnecessary, so that there is no reduction of yield due to the decarburization or desiliconization; and (3) Amorphous starting materials can be produced by mixing and diluting the amorphous mother alloy with molten steel, particularly molten steel obtained by mass production system such as blast furnace-converter, so that the production cost of the amorphous starting material can be reduced considerably.

What is claimed is:

1. In a method of producing amorphous mother alloys by charging a mixture of raw material, carbonaceous reducing agent and secondary material into a furnace and smelting it to produce Fe-B-Si series molten metal having a B-Si composition range which lies within an area represented by the trapezoidal area abcd shown in FIG. 2 of the accompanying drawings, the improvement wherein B, Si and Fe contents contained in said mixture to be charged into said furnace are adjusted so as to satisfy $0.4 < B_2O_3/SiO_2 < 2.5$ and $0.08 < SiO_2/Fe_2O_3$ on a weight conversion of each oxide, and the resulting molten metal satisfies $\frac{1}{4} < Si/B < 1$ and $B + \frac{2}{3}Si > 30$ on atomic %.

2. A method of using amorphous mother alloys, which comprises diluting the amorphous mother alloy of Fe-B-Si series molten metal as claimed in claim 1 with molten steel separately refined to produce an amorphous starting material satisfying the following relations on atomic %:

$$\frac{1}{4} < Si/B < 1,$$

$$16 < B + \frac{2}{3}Si < 25,$$

and $$C < 1.$$

* * * * *